United States Patent [19]

Sabroff et al.

[11] Patent Number: 4,709,569

[45] Date of Patent: Dec. 1, 1987

[54] METHOD FOR PRODUCING GEARS

[75] Inventors: Alvin M. Sabroff, Mentor, Ohio; Samuel C. Chambers; James C. Ream, both of Glasgow, Ky.

[73] Assignee: Eaton Corporation, Cleveland, Ohio

[21] Appl. No.: 484,800

[22] Filed: May 2, 1983

Related U.S. Application Data

[63] Continuation of Ser. No. 238,255, Feb. 25, 1981, abandoned.

[51] Int. Cl.[4] ..... B21J 1/06

[52] U.S. Cl. ..... 72/340; 72/364

[58] Field of Search ..... 72/38, 39, 340, 342, 72/364, 377; 148/12 F

[56] References Cited

U.S. PATENT DOCUMENTS 1,968,792 7/1934 Yeomans ..... 72/256

2,325,989 8/1943 Tryon ..... 72/340

3,156,043 11/1964 Grazioso et al. ..... 72/38

4,222,260 9/1980 McDermott ..... 72/364

FOREIGN PATENT DOCUMENTS 951678 7/1974 Canada ..... 72/358

*Primary Examiner*—Lowell A. Larson

*Attorney, Agent, or Firm*—D. A. Rowe; H. D. Gordon

[57] ABSTRACT

A method for precision forging of low to medium carbon level carbon and/or alloy steels is provided. The method include the steps of heating the properly prepared billets (20), preferably in a minimum oxidizing environment (36), to a preselected temperature falling in the range of 0.68–0.74, preferably 0.69–0.73, of the homologous temperature ratio (HTR) of the billet material and then precision forging the heated billets while at the preselected temperature.

3 Claims, 3 Drawing Figures

METHOD FOR PRODUCING GEARS

This is a continuation of application Ser. No. 238,255, filed Feb. 25, 1981, now abandoned.

BACKGROUND OF THE INVENTION

1. Field of the Invention

The present invention relates to a precision forging process and more particularly to a process for precision forging low to medium carbon level carbon and alloy steel parts at a preselected temperature falling in the range of 0.68–0.74, preferably in the range of 0.69–0.725, for the homologous temperature ratio of the billet material.

2. Description of the Prior Art

Forging of low to medium carbon level carbon and alloy steel parts is well known in the prior art. The prior art methods for forging such steels have generally comprised so called cold forging, i.e. forging at substantially ambient temperatures; so called warm forging, i.e. forging at approximately 1300° F.–1600° F. (704° C.–871° C.) and conventional hot forging, i.e. forging at 2100° F. (1140° C.) or above.

The prior art forging methods for low to medium carbon level carbon and alloy steel parts may be appreciated in more detail by reference to U.S. Pat. Nos. 1,345,045; 2,821,016; 3,066,408; 3,378,903 and 3,557,587, all of which are hereby incorporated by reference.

The prior art forging methods for forging low to medium carbon level carbon and alloy steels, while widely used, were not totally satisfactory for certain forging operations as an optimal, or at least improved, combination of forging process parameters, such as required labor, required forging pressure, tool life, energy usage, microstructure, required machining, machinability, die fill, ease of billet removal from dies, carburization, etc. was desired.

SUMMARY OF THE INVENTION

In accordance with the present invention, the drawbacks of the prior art methods have been minimized by providing a forging process for low to medium carbon level carbon and alloy steels, (such as AISI 8822A, 8620A, 48Al and 4817H) by which precision forgings may be produced having a more desirable combination of forging parameters such as microstructure, machinability, reduced machining to produce a finished part, degree of carburization, tool life, process labor, forging pressure required, and the like. The above is accomplished by providing a forging process to produce precision low to medium carbon level carbon and alloy steel forgings comprising the steps of providing a properly shaped, sized and cleaned billet; heating the billet, preferably in a minimum oxidizing envi:onment, to a predetermined temperature falling in the range of 0.68–0.74, preferably 0.69–0.725, for the homologous temperature ratio of the billet material, forging the heated billet while at the preselected temperature to the desired shape, and allowing the forging to cool, preferably in air, to a substantially ambient temperature.

Accordingly, it is an object of the present invention to provide a new and improved precision forging process for forging low to medium carbon level carbon and alloy steels.

Another object of the present invention is to provide a new and improved precision forging process for forging low to medium carbon level carbon and alloy steels which will provide an improved combination of forging variables such as forged part machinability, forging microstructure, amount of material to be removed from the forging to obtain finished part, degree of carburization, degree of scaling, tool life, required energy usage, required forging pressure and the like.

These and other objects and advantages of the present invention will become apparent from a reading of the description of the preferred embodiment taken in connection with the attached drawings.

BRIEF DESCRIPION OF THE DRAWINGS

DESCRIPTION OF THE PREFERRED EMBODIMENT

The process of the present invention involves a forging method for precision forging low to medium carbon level steels.

Forgings are conventionally defined as either "blanks", i.e. massive machining (removal of at least 0.090 inch of material) of all functional surfaces required; "close tolerance preforms", i.e. machining required on all functional surfaces; "precision preforms", i.e. some but not all functional surfaces require machining or "net parts", i.e. part is usable as forged (subject to heat treating and other non machining steps).

As used herein, the term "precision forging", and derivatives thereof, will refer to a forging process capable of producing close tolerance preforms, precision preforms or net parts, all of which require less than 0.060 inch of material removal from any functional surface. In practice, the process of the present invention has produced forgings, such as spur and bevel gear preforms or net forgings usually requiring 0.030 inch or less of material removal from any functional surface.

The term "low to medium carbon level carbon and alloy steel", and derivatives thereof, as used herein and as generally used in the art will refer to steels having a carbon content of 0.05% to 0.50% by weight. The term "AISI" shall refer to the American Iron and Steel Institute and the steel classification standards established thereby.

In forging, i.e. bulk deformation of a workpiece under pressure, there are many parameters or variables, the combination of which are hopefully optimized in selecting a forging process for a particular situation.

The process of the present invention provides an optimal, or near optimal, combination of selected parameters for the precision forging of low to medium carbon level carbon and alloy steels. The present process has been utilized primarily to produce precision spur and bevel gear forgings from steels such as AISI 8620A, 8822A, 4817H and the like. However, the process is not limited to any particular forging configuration and/or specific type of low to medium carbon level carbon and alloy steel.

In a forging process, the following are usually among the parameters the combination of which is to be optimized. Energy usage is greater with higher temperature forging and with forging processes requiring multiple heating of a workpiece, forging pressure required generally increases with lower forging temperatures, machinability is related to microstructure which is a function of the forging temperature and cooling rate, hardness is a function of temperature and generally increases with lowered forging temperatures and is also a function of the cooling rate. The present invention, while not maximizing all parameters, does provide an optimal or near optimal combination of parameters.

Figure 1:
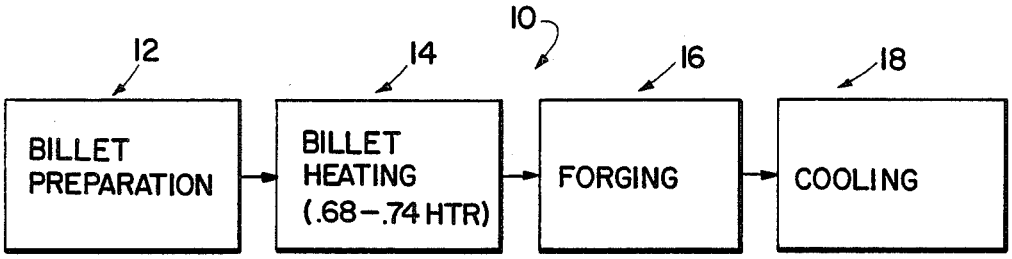
FIG. 1 is a block diagram of the process of the present invention.

The present process is illustrated in block diagram form in FIG. 1. The process 10 includes the following sequential steps described in greater detail below: billet preparation, 12; billet heating, 14; forging of the billet into a precision forged workpiece, 16 and cooling the workpiece, 18.

The billet or slug 20 (see FIG. 2 and 3) is cut to a predetermined size and shape from bar or wire stock of low to medium carbon level carbon and alloy steel which has been cleaned. If the forged workpiece, or forging, is to be a preform, tumble or shot blasting is normally sufficient for stock cleanup. If the forged workpiece, or forging, is to be a net part, the stock will normally be cleaned by grinding, such as centerless grinding or the like.

The billet 20 is then heated to a preselected temperature in the range of 0.68 to 0.74 of the homologous temperature ratio (HTR) of the billet material. Preferably, the billet will be heated to a temperature in the range of 0.69 to 0.73, or more preferably, in the range of 0.69 to 0.71, of the homologous temperature ratio of the billet material.

The homologous temperature ratio (HTR) of a material may be defined by the following:

$$HTR = \frac{\text{temperature } (^\circ K) \text{ of material}}{\text{melting temperature } (^\circ K) \text{ of material}}$$

Figure 2:
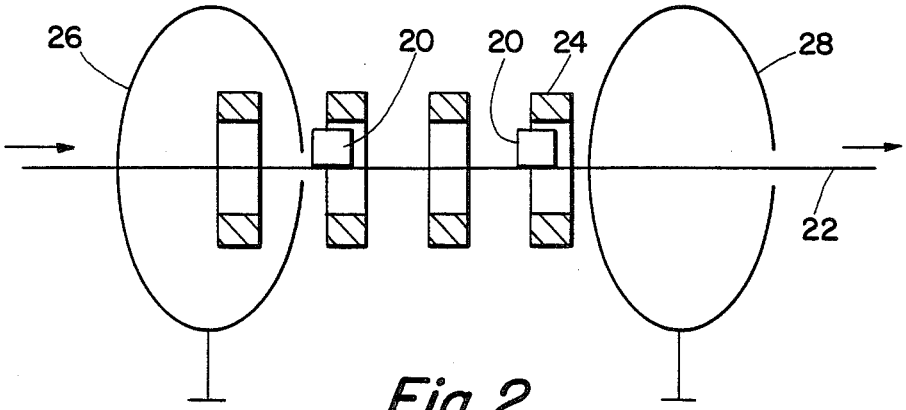
FIG. 2 is a schematic illustration of one embodiment of the heating apparatus utilized in the present invention.

To minimize scaling, (oxidation) and depth of scaling of the heated billet, the billet is preferably heated as quickly as practical and may be heated in a nonoxidizing or minimum oxidizing environment. One example of a known minimum oxidizing environment, billet heating arrangement may be seen by reference to FIG. 2. In FIG. 2, the billets 20 are moved by a conveyor means 22, preferably a variable speed conveyor, through a close fitting induction coil heater 24. Conveying means 22 may be a walking beam, a push bar or the like. Gas burners, such as the illustrated ring burners, 26 and 28, at the entrance and exit ends, respectively, of the coil may be provided to consume oxygen and partially shield the coil from ambient oxygen.

Figure 3:
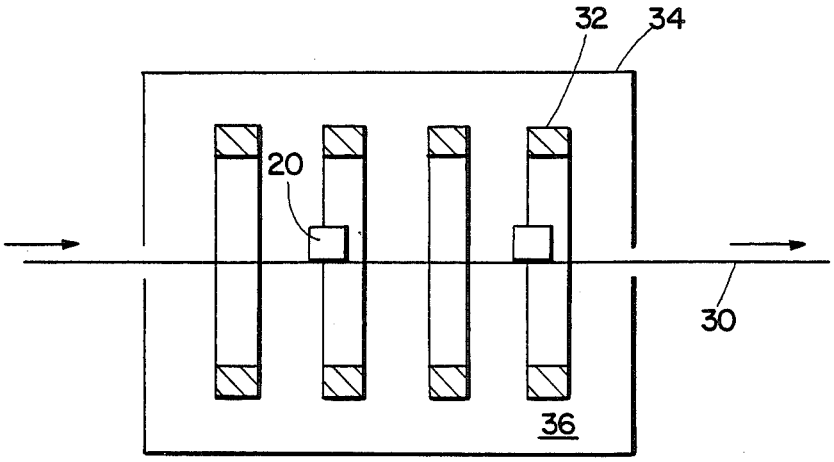
FIG. 3 is a schematic illustration of another embodiment of the heating apparatus utilized in the present invention.

Another example of a known minimum or non oxidizing billet heating arrangement may be seen by reference to FIG. 3. In FIG. 3, the billets 20 are moved by a conveyor 30 through an induction coil heater 32 which is surrounded by a chamber 34 having an atmosphere 36 of an inert gas or a non oxidizing gas such as nitrogen.

In a typical example, a billet of AISI 8620A steel, a common low to medium carbon level alloy steel, is heated to a preselected temperature of about 1800° F. (1255° K.) to 1900° F. (1310° K.). As AISI 8620A steel has a melting temperature of about 2800° F. (1810° K.), the resulting HTR is in the range of 0.693 (1255/1810) to 0.723 (1310/1810).

The heated billets, while at substantially the preselected temperature, are then moved to a forge machine, such as a press or hammer, and subjected to a forging pressure to produce a precision forging. The forge press or hammer may utilize a single die or tool in a single stroke operation (usually preforms) or progressive inital forming and finish dies or tools (usually net parts) as is well known in the forge art.

After the forging operation, the hot forged workpieces, or forgings, are then cooled, preferably in air on a cooling table or in special cooling racks, to ambient temperature.

It has been found that when heating is in a non oxidizing or minimized oxidizing environment, a billet may be heated at the upper end of the process HTR range, that is at about an HTR of 0.74 (for AISI 8620A steel, about 1950° F.) while heating in air is preferably at the lower end to the middle of the process HTR range, that is at about an HTR of 0.68–0.71 (for AISI 8620A steel, about 1756° F. to 1850° F.) to avoid scaling and reduce the depth of decarburization.

The process of the present invention has been found to provide an improved, highly desirable combination of variables. The process is believed to provide an optimal, or near optimal compromise of forging and microstructure variables for the precision forging of low to medium carbon level carbon and alloy steels.

The process has been found to provide good machinability of the precision forgings as the microstructure is a polygonal ferrite and pearlite equiaxed grain with no, or only a minimum of, undesirable Widmanstatten structure. The grain size is generally fine (i.e. less than G.S. No. 10 on the ASTM Scale).

Scaling is minimized, and is usually either chemically or mechanically removable. Decarburization, and the depth of decarburization, is also within generally acceptable limits and below the levels usually associated with conventional hot forging.

The as forged and cooled preform forgings require no heat treatment prior to the finish machining operations.

The total process energy requirements, comprising the sum of: energy required for billet preparation, energy required for billet heating, forging energy, energy required for heat treatment after forging for proper machinability and the energy required for machining, is at a minimal, or near minimal, level.

It may be seen from the above that the process of the present invention provides a new and highly desirable method for the precision forging of low to medium carbon level carbon and alloy steels.

The above description of the preferred embodiments of the present invention are provided for illustrative purposes only and it is understood the present invention is susceptible to modification, variation or change without departing from the spirit and the scope of the invention as hereinafter claimed.

We claim:

1. A method of producing a spur or bevel gear of low to medium carbon level carbon or allow steel comprising the steps of:

(a) providing a properly sized, shaped and cleaned billet of a given low to medium carbon level carbond or ally steel having a carbon content of not more than 0.30%;

(b) heating the billet in a minimum oxidizing environment to a preselected temperature falling in the range of 0.069–0.71 for the homologous temperature ratio of the billet material;

(c) locating the heated billet in a first die member on a forging machine;

(d) precision forging the billet while substantially at said preselected temerature by engaging the heated billet with a second die member complementary with the first die member in a single forge flow to form a gear precision preform;

(e) removing the preform and allowing the preform to cool in air to substantially ambient temperature; and (f) machining less than 0.060 inch of material from the exterior functional surfaces of the cooled preform without subjecting the cooled preform to any heat treating operation prior to said machining.

2. The process of claim 1, wherein the machining of step f) comprises machining less than 0.030 inch of material from the exterior functional surfaces of the cooled preform.

3. A method of producing a spur or bevel gear of low to medium carbon level carbon or alloy steel comprising the steps of:

(a) providing a properly sized, shaped and cleaned billet of a given low to medium carbon level carbon or alloy steel having a carbon content of not more than 0.30%;

(b) heating the billet in a minimum oxidizing environment to a preselected temperature falling in the range of 0.71–0.74 for the homologous temperature ratio of the billet material;

(c) locating the heated billet in a first preform die member on a forging machine;

(d) forging the billet while substantially at said preselected temperature by engaging the heated billet with a second preform ide member complementary with the first preform die member to form a gear close tolerance preform;

(e) immediately locating the gear close tolerance preform in a first finish die member on a forging mahcine;

(f) forging the gear close tolerance preform by engaging the gear preform with a second finish die member complementary with the first finish die member to form a precision forging;

(g) removing the precision forging and allowing the precision forging to cool in air to substantially ambient temperature; and (h) machining less than 0.030 inch of material from the exterior functional surfaces of the cooled precision forging without subjecting the cooled precision forgoing to any heat treating operation prior to said machining.

* * * * *